United States Patent [19]

Hegarty

[11] Patent Number: 5,060,904

[45] Date of Patent: Oct. 29, 1991

[54] MULTI-POSITIONABLE SUPPORT STAND WITH MOVABLE CENTER OF GRAVITY AND ARTICLE HOLDING MEANS

[76] Inventor: David Hegarty, 36 Wyatt Rd., Garden City, N.Y. 11530

[21] Appl. No.: 571,765

[22] Filed: Aug. 23, 1990

Related U.S. Application Data

[63] Continuation of Ser. No. 442,247, Dec. 28, 1989, abandoned, which is a continuation-in-part of Ser. No. 273,404, Nov. 18, 1988, Pat. No. 4,925,146, which is a continuation of Ser. No. 45,630, May 1, 1987, Pat. No. 4,787,595.

[51] Int. Cl.[5] ..... A47G 1/24

[52] U.S. Cl. ..... 248/454; 248/447; 248/458

[58] Field of Search ..... 248/454, 455, 456, 450, 248/451, 452, 453, 447, 447.2, 295.1, 296, 298; 402/70, 75, 73; 403/381, 375, 354, 331; 281/47, 40

[56] References Cited

U.S. PATENT DOCUMENTS

| | | | |
|---|---|---|---|
| 2,003,746 | 6/1935 | Hedington | 248/456 X |
| 2,323,123 | 6/1943 | Donato et al. | 281/47 |
| 2,325,155 | 7/1943 | Wedge | 402/75 |
| 2,502,275 | 3/1950 | Perlin | 402/75 X |
| 2,562,518 | 7/1951 | Abrams | 281/19 R X |
| 2,568,131 | 9/1951 | Segal | 402/70 |
| 2,620,801 | 12/1952 | Panfil, Sr. | 402/75 |
| 2,721,417 | 10/1955 | Dickinson | 248/453 |
| 3,043,047 | 7/1962 | LaFlewr | 248/454 |
| 3,095,665 | 7/1963 | Killen | 248/452 X |
| 3,366,359 | 1/1968 | Wolf et al. | 248/447 |
| 3,425,421 | 2/1969 | Feder | 281/48 |
| 4,009,599 | 3/1977 | Patriquin | 70/90 |
| 4,116,413 | 9/1978 | Andersen | 248/455 X |
| 4,179,091 | 12/1979 | Bidney | 248/295.1 X |
| 4,341,166 | 7/1982 | Cantley | 70/85 X |
| 4,444,418 | 4/1984 | Goldstein | 402/75 X |
| 4,462,317 | 7/1984 | Franko et al. | 70/63 X |
| 4,564,732 | 1/1986 | Lancastek et al. | 403/381 X |
| 4,568,052 | 2/1986 | Solomon et al. | 248/477 X |
| 4,582,442 | 4/1986 | Rager | 402/75 |
| 4,583,877 | 4/1986 | Wilson | 402/75 |
| 4,643,384 | 2/1987 | Guerin | 248/453 X |
| 4,691,541 | 9/1987 | McQuade, Sr. | 70/77 |
| 4,722,627 | 2/1988 | Salacuse | 402/75 X |
| 4,776,552 | 10/1988 | March | 248/455 |
| 4,787,595 | 11/1988 | Hegarty | 248/454 |
| 4,925,145 | 5/1990 | Hegarty | 248/454 |
| 4,925,146 | 5/1990 | Hegarty | 248/454 |

FOREIGN PATENT DOCUMENTS

| | | | |
|---|---|---|---|
| 094123 | 8/1949 | France | 446/127 |

*Primary Examiner*—Ramon O. Ramirez

[57] ABSTRACT

An article support stand for removably or permanently mounting an article holder on the stand includes a main body which may be formed in the shape of a truncated pyramid. The body has the ability to contain a moveable weight which shifts the center of gravity when the stand is repositioned. The body has a mounting side, and first and second support sides for supporting the stand on a workbench or table top. An elongated bracket defining a T-slot is mounted on the mounting side of the body. The article holder includes an elongated member configured as a T-shaped rail which is receivable by the bracket of the stand so that the article holder may be mounted on the stand. The stand may be rotated 90 degrees from one support side to the other so that the mounting side and the article holder mounted on the mounting side may be disposed in different mounted positions.

15 Claims, 11 Drawing Sheets

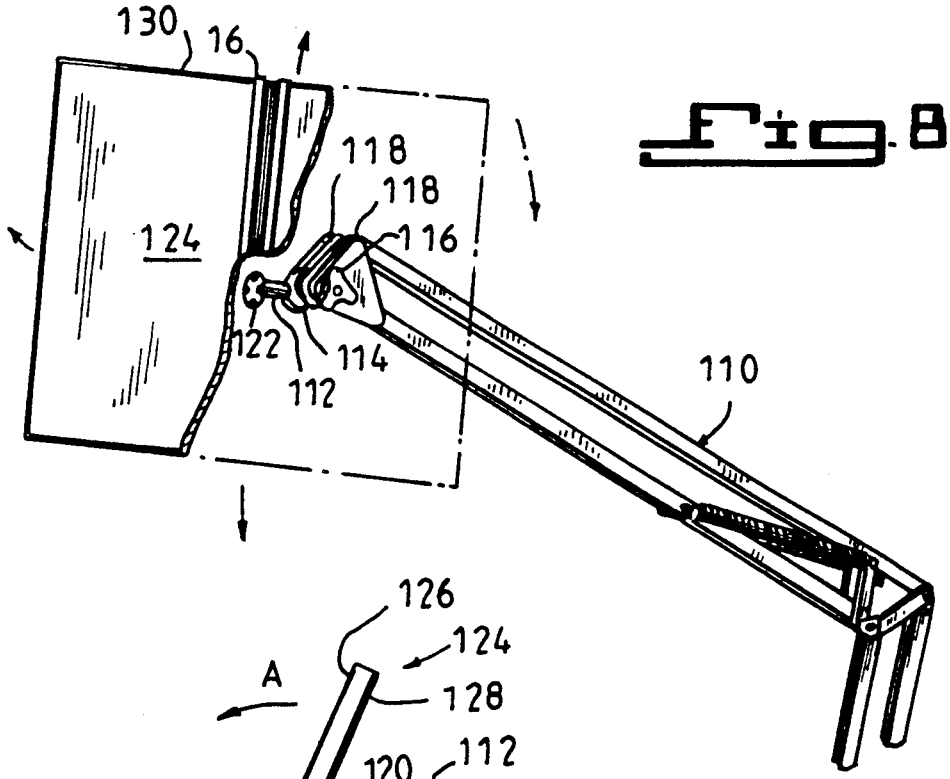
Fig. 8
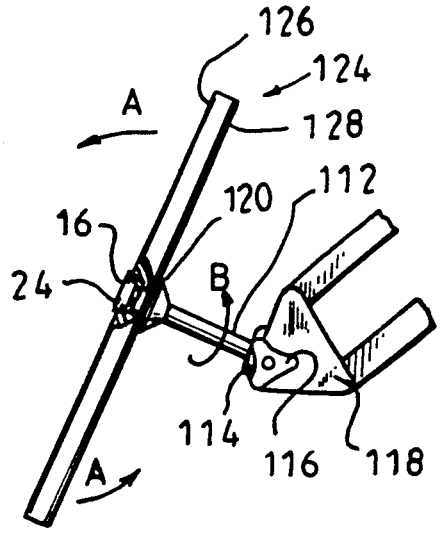
Fig. 9
Fig. 10
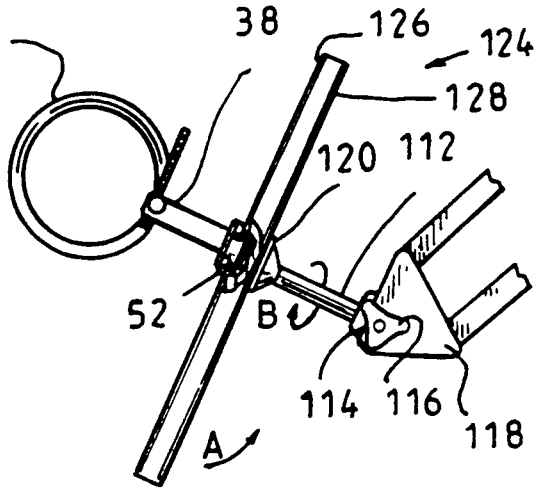

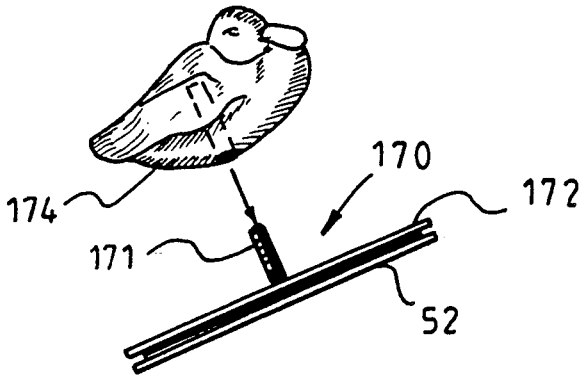
Fig. 11
Fig. 12
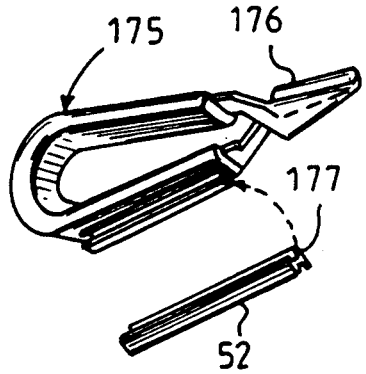
Fig. 13
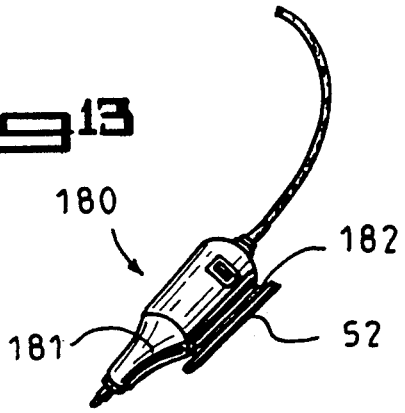
Fig. 15
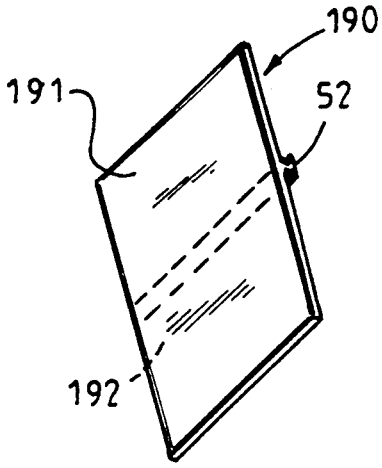
Fig. 14
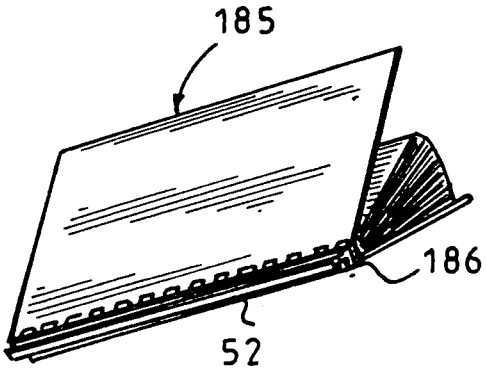

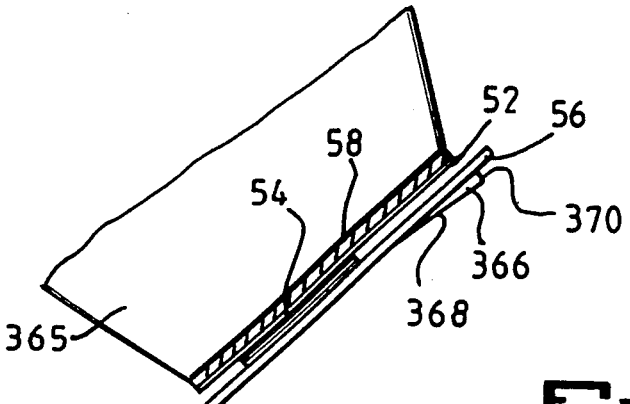
Fig.16
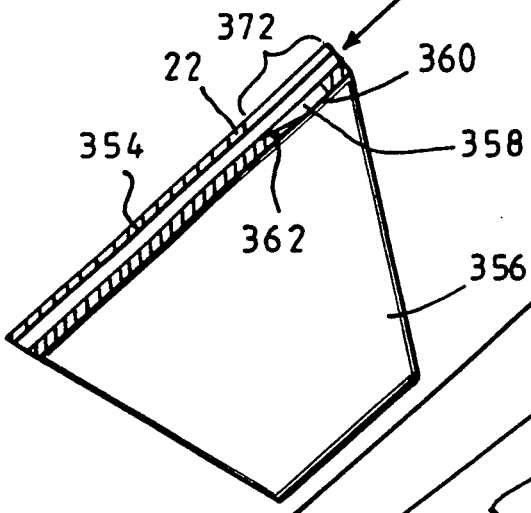
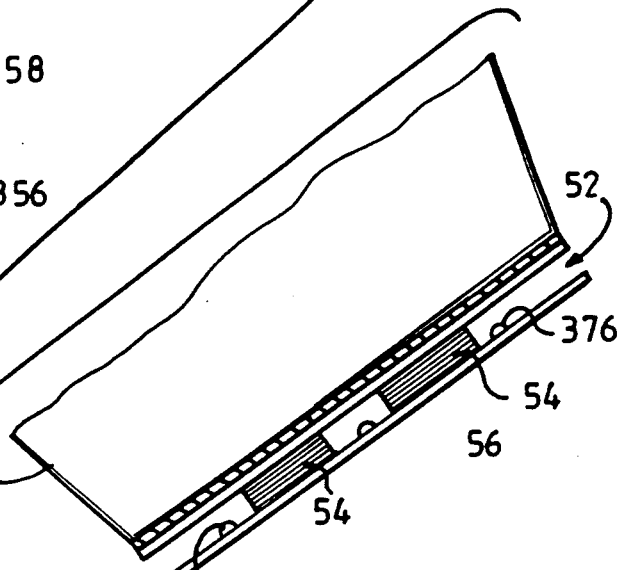
Fig.17
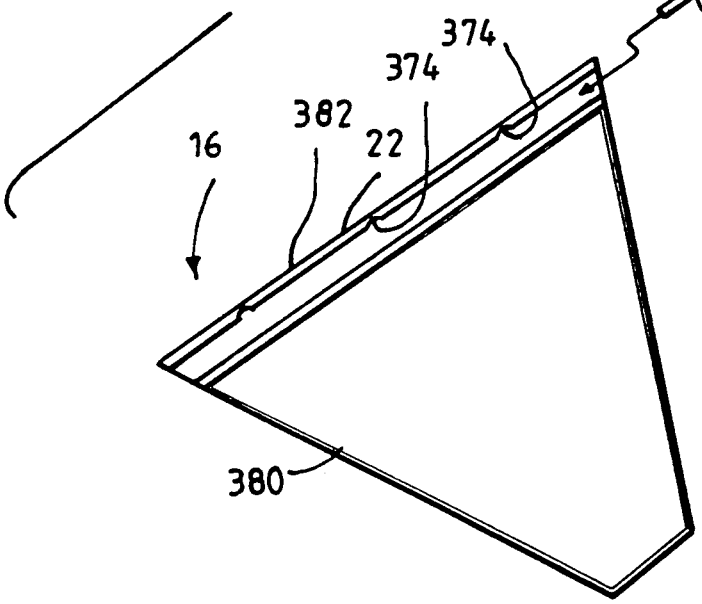

400
420
24
410
26
412
28

470
472
473
475
477
476
460
471
124
450
24

470
110
476
479
478

111
481
470
400
476

MULTI-POSITIONABLE SUPPORT STAND WITH MOVABLE CENTER OF GRAVITY AND ARTICLE HOLDING MEANS

CROSS-REFERENCE TO RELATED APPLICATION

This application is a continuation of co-pending prior application Ser. No. 442,247, filed Nov. 28, 1989, abandoned, which is a continuation-in-part of co-pending prior application Ser. No. 273,404, filed Nov. 18, 1988 (now U.S. Pat. No. 4,925,146) which is a continuation of Ser. No. 045,630, filed May 1, 1987, which is U.S. Pat. No. 4,787,595.

BACKGROUND OF THE INVENTION

1. Field of the Invention

This invention relates to support stands and more particularly to a multi-positionable support stand having a movable center of gravity for supporting an article in two or more dispositions either independently or in combination with an article holder which can be selectively interlocked with the support stand.

2. Description of the Prior Art

The term "article" hereinafter refers to a planar type object which the user desires to mount on the stand such as a picture, mirror or chart as well as those objects, both modified and unmodified, such as watches, jewelry, paintable items, printed circuit boards and so forth which thru the cooperation of a variety of interlocking object holding means may be removably mounted on the multi-positionable support stand.

The term "hold" hereinafter refers to the ability to maintain a mounted article on a support stand either by a restraining means which is an integral part of the stand itself or via the cooperation of the stand's mounting means with a variety of interlocking, removably mountable article holders which are capable of either permanently or temporarily restraining an article.

The term "article holder" hereinafter refers to that type of device which is adapted to hold an article, such as in the form of a clamp, vise, heat sink, threaded rod or the like, as well as conventional articles and article support devices, such as will be described, which are modified in accordance with the principles of this invention.

Article support stands for supporting an article or article holder are well-known in the art and come in a variety of configurations and structure.

To my knowledge the most recent art which is somewhat related to the inventive concepts of this application can be found in two of my previous applications the disclosures of which are herby incorporated by reference. The first application, has been issued U.S. Pat. No. 4,787,595 and is entitled "Multi-positionable Document Support Stand and Interlocking Document Holder". The second application, filed Nov. 18, 1988, has been issued U.S. Pat. No. 4,925,146. These two disclosures do not, however, provide for multi-positionable stands which cooperate with an assortment of interchangeable workholders, nor does the issued patent provide for shifting the center of gravity when the stand is placed in different rest positions. Furthermore, the previous disclosures do not present a multi-positionable article support stand which has both a permanently attached article holder, such as a stand for holding pictures, which further includes a means to shift the center of gravity with each new rest position of the stand.

The inadequacy of other multi-positionable article support stands having fixed sides has resulted in stands which present articles at similar angles, no matter what the stands purpose. The need for stability in different dispositions has required that the stand must be manufactured within certain angular limits. The advantages of presenting a mounted article at various angles on the same stand having fixed sides have been unrecognized.

For example, current workholding devices require much adjustment and realignment when working on an article. No current work stand permits the repostioning (without adjustment) of a firmly mounted article, such as a figure or model to be painted, allowing the article to be placed in a different disposition, and yet maintaining the stability of the stand if the respective angular dispositions are considerably different.

A further disadvantage of current support stands for holding a workpiece is that they do not provide for a common supporting means for mounting and accurately repositioning a selection of different article holders on both stationary and multi-positionable workholding stands. Although slots are available on stands such as drill presses they are limited in that they are simply used to hold a workholding piece such as a vice. The vice must be readjusted each time a new angle is desired.

The state of the art prior to the present invention required that the manufacturer of multi-positionable stands plan for the weight distribution of parts and how they related to function in order to make certain that the stand would remain stable in all dispositions.

Another important disadvantage of conventional support stands is that they are limited in the degree of angularity and stability which they can provide to removably mountable article holders.

It may be desirable to display an article by means of a stable stand having fixed sides and various angles of presentation. For example, a stand which can present a picture not only in both landscape and portrait views but also at two different angular orientations with respect to the horizontal in each respective view. Such a stand would provide for a different angle of viewing depending whether the stand were at workbench level or if it were on a high shelf where a larger viewing angle with the horizontal would be desirable. Current stands trying to achieve such a purpose would topple if the respective angles were considerably dissimilar. Current stands do not provide for moving the center of gravity when necessary in order to insure stability in different dispositions.

Many conventional stands such as easel type stands for supporting articles like pictures or mirrors are designed to rest on a workbench or table top, and to support the article at a mounting angle to the horizontal.

One of the primary disadvantages of many conventional multi-positionable article support stands is that they are limited in the degree of angularity and stability which they can provide to the mounted article.

For example, picture stands of the plexiglass type are often small, having a small "footprint" and light in weight and thus are often capable of supporting a picture in only one disposition (portrait or landscape view). However, when a stand is required to provide support both in the landscape disposition (long side of stand lies horizontally) as well as in the portrait disposition (short side of stand lies horizontally) the physical forces which are present require that the stand be larger, having a larger footprint, to provide adequate support. Additionally, the combination of a lightweight stand and dual disposition support requirements results in limiting the angles of inclination which can be used in order that the stability of the stand in both dispositions is maintained.

OBJECTS AND SUMMARY OF THE INVENTION

It is an object of the present invention is allow support stands for holding a workpiece a common support means for a selection of article holders in order to allow the holders to be mountable and accurately repositionable on both stationary and multi-positionable workholding stands. The present invention allows the article being held to be easily presented at a new angle and orientation simply by utilizing a different support side. Additionally, past angles and positions of orientation can be accurately recalled simply by placing the stand on the former support side.

It is another object of the present invention to provide for the manufacture of a multi-positionable article support stand without undue concern for the weight distribution of its parts and how they relate to function.

It is yet another object of the present invention to provide for a multi-positionable stand having selective angularity and increased stability when supporting a variety of articles thru the cooperation of an assortment of removably mountable article/work holders.

It is a further object of the present invention to provide a multi-positionable workholding stand which provides a means to shift the center of gravity when the stand's disposition is changed in order to provide continued stability to the article/workpiece being held at angles which may vary with the disposition.

It is a still further object of the present invention to provide a multi-positionable workholding suport stand for an article whose weight can be easily changed allowing the stability of the stand to be in proportion to the unstabling forces of the article/workpiece being held.

It is yet a further object of the present invention to improve workholders for use in combination with stationary support stands.

It is still another object of the present invention to provide for versatility in displaying articles which are used for visual reference by a viewer such as pictures, mirrors, charts and signs.

It is a further object of the present invention to increase the stability and versatility of multi-positionable article support stands, such as easel type picture stands, by allowing for a greater degree of angular variability on the same support stand while maintaining the stand's stability in different viewing dispositions.

It is a still further object of the present invention to provide a multi-positionable support stand for pictures, mirrors and the like which can be manufactured easily and economically yet provides for a means to shift the center of gravity when the stands angle and or orientation is changed thereby increasing the angular variability and stability of such stands.

In accordance with one aspect of the present invention, the article support stand includes a main body which may be formed in the shape of a truncated pyramid. The body has a mounting side (which is defined by the base side of the truncated pyramid body), and first and second support sides for supporting the stand on a workbench or table top, or other support surface. The support sides are transversely disposed to each other and preferably constitute adjacent sides on the truncated pyramid body. Thus, the body may be rotated 90 degrees with either its first or second support side resting on the workbench or table top, so that the mounting side may be disposed in different positions.

The main body of the stand includes a mounting device for removably mounting an article holder on the body. The mounting device is secured to the mounting side of the main body.

In a preferred form of the invention, the mounting device is an elongated bracket, C-shaped in cross-section, which defines a T-slot having an exposed open end. The bracket is mounted in a recess formed across the surface of the main body's mounting side.

The article support stand may be hollow, and include on its inside a movable weight, such as in the form of a liquid, lead pellets or the like, which allows the center of gravity of the article support stand to change when the stand is repositioned from one support side to another.

According to the present invention, an article holder, such as a clamp, includes an article mounting device (for example, the jaws of the clamp), a support for the article mounting device (for example, the body of the clamp on which the jaws are mounted) and an elongated member for mounting the article holder on the support stand.

According to another embodiment of the invention, an article holder, includes an article, such as a motorized tool, a support for the article, for example the back plate of a T-rail attached to or formed in the body of the tool, and an elongated member for mounting the article holder on the support stand. The elongated member in its preferred form is T- shaped in cross-section and, in the example above of a clam -type- article holder, is mounted on the heel of the clamp's body. The T-shaped member of the holder is slidably received by the C-bracket of the stand through the C-bracket's exposed open end, so that the article holder may be secured to the mounting side of the stand's main body.

Positioned thusly on the stand, the article holder and the article may be disposed in different positions, thereby placing a mounted article in a plurality of different positions and orientations by simply rotating the stand 90 degrees so that the stand rests on a different support side. The combination of a multipositionable article support stand and article holder provides for the positioning of a workpiece, such as a paintable mounted figure, in a number of selectable positions allowing the artist to approach the piece from different orientations simply by moving the stand to a different support side.

A latching mechanism in the form of a cooperating wedge protrusion and conforming recess mounted on the elongated T-shaped member of the article holder and formed in the C-bracket of the stand, respectively, or vice versa, may be included to ensure that the article holder remains secured to the stand until intentionally removed.

These and other objects, features and advantages of this invention will be apparent from the following detailed description of illustrative embodiments thereof, which is to be read in connection with the accompanying drawings.

BRIEF DESCRIPTION OF THE DRAWINGS

FIG. 8 is a perspective view, partially broken away, of an article support stand, constructed in accordance with a sixth form of the present invention.

FIG. 9 is a fragmentary side view of the article support stand shown in FIG. 8, with the main body of the stand rotated 90 degrees from the mounting position shown in FIG. 8.

FIG. 10 is a view similar to that of FIG. 9 having an article holder mounted thereon.

FIG. 11 is an exploded, perspective view of an article holder constructed in accordance with a second form of the present invention.

FIG. 12 is an exploded, perspective view of an article holder, constructed in accordance with a third form of the present invention.

FIG. 13 is a perspective view of an article holder constructed in accordance with a fourth form of the present invention.

FIG. 14 is a perspective view of an article holder constructed in accordance with a fifth form of the present invention.

FIG. 15 is a perspective view of an article holder constructed in accordance with a sixth form of the present invention.

FIG. 16 is a longitudinal cross-sectional view of the article holder and article support stand, modified to include a latching mechanism.

FIG. 17 is a longitudinal cross-sectional view of portions of the article holder and stand, illustrating another form of a latching mechanism.

DETAILED DESCRIPTION OF THE PREFERRED EMBODIMENTS

Figure 1:
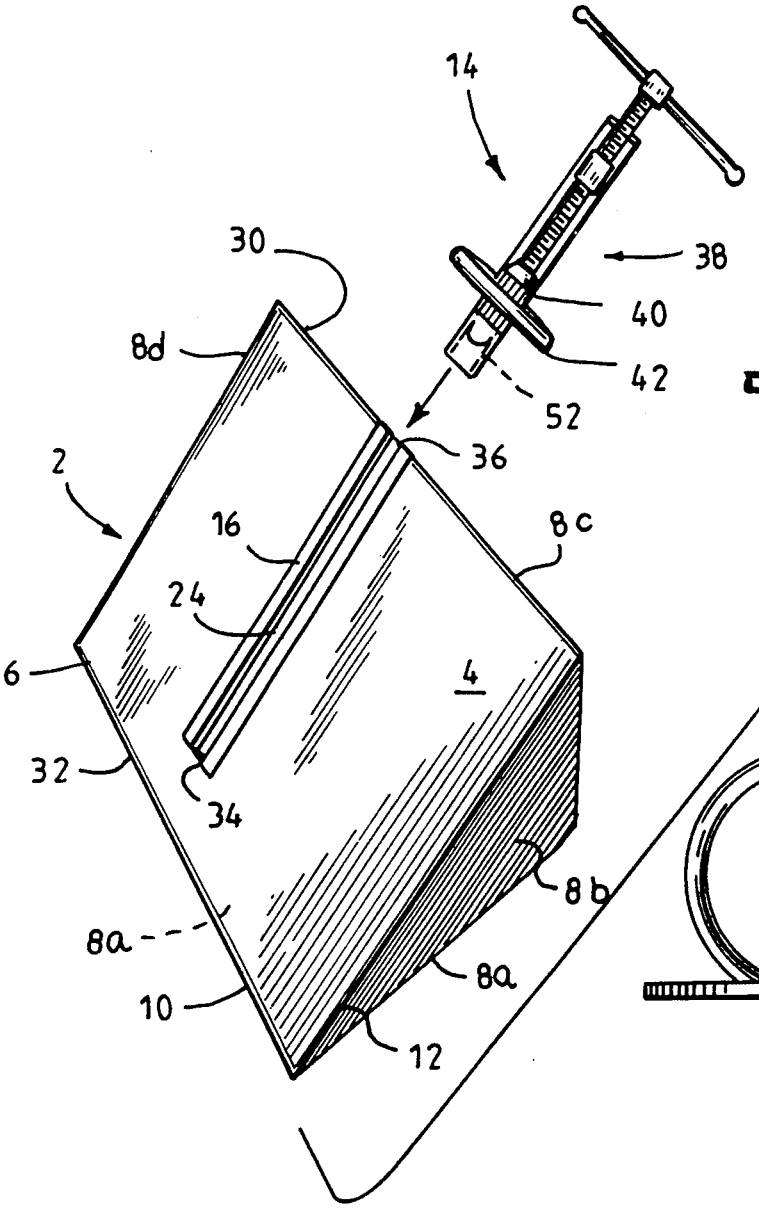
FIG. 1 is a front perspective view of an article support stand and an article holder, constructed in accordance with one form of the present invention.
Figure 2:
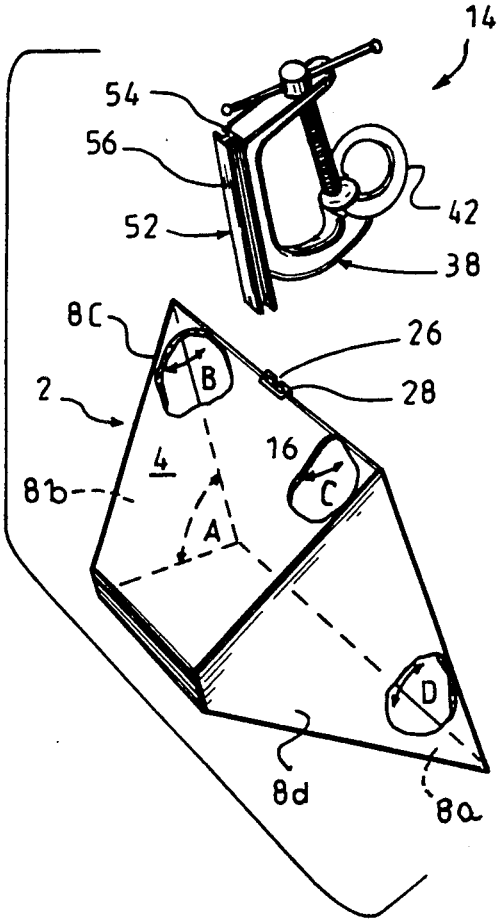
FIG. 2 is a rear perspective view of the article support stand and article holder shown in FIG. 1, with the article support stand partially broken away at portions thereof.

Initially referring to FIGS. 1 and 2, it will be seen that an article support stand 2, constructed in accordance with one form of the present invention, includes a main body 4 formed in the shape of a truncated pyramid. The body 4 may be of solid construction, for enhanced stability, or formed from a series of joined or integral sides to provide the overall configuration of the truncated pyramid.

In this form of the invention, the main body 4 includes a mounting side 6 (defined by the base of the truncated pyramid construction), and four support sides 8*a*, 8*b*, 8*c*, 8*d* (defined by the truncated pyramid's mutually converging sides). The mounting side 6 is planar in nature, to provide a flat surface for holding and mounting an article mounted thereon, as will be explained. The four support sides 8*a–d* are also planar, to provide a stable, flat surface on which the stand may rest when positioned on a workbench or table top or other horizontal support surface.

In the embodiment illustrated by FIGS. 1 and 2, two sides 8*a*, 8*b* are of initial importance in supporting the stand, although four sides provide greater versatility in positioning the stand on the workbench or table top.

The two sides 8*a*, 8*b* which are used for support are transversely disposed to each other (each being joined to one of transversely disposed first and second edges 10, 12 of the mounting side), and define adjacent sides of the truncated pyramid body. Referred to hereinafter as the first and second support sides 8*a*, 8*b*, they extend angularly from the mounting side 6 on the same side of the plane in which the mounting side resides.

The mounting side 6 is disposed at a substantial angle to the horizontal in order to provide for diversity in positioning mounted articles. Preferably, the angle A defined by the first support side 8*a* and the mounting side 6 (at the first edge 10), and the angle B defined by the second support side 8*b* and the mounting side 6 (at the second edge 12), are each about 40 degrees to provide the desired angle of mounting. If each angle is selected to be the same, then the 40 degrees slope of the mounting side 6 with respect to the workbench or table top will be maintained in all dispositons of the stand, that is, when the stand is resting on any support side 8*a*, 8*b*. However, it may be desirable to form the stand with different angles A and B, for example, 40 and 50 degrees respectively, so that the user may select his preferred angle by merely rotating the stand to rest on a corresponding support side 8*a*, 8*b*.

Sides 8*c* and 8*d* are similarly joined to edges of the mounting side 6, with side 8*c* opposite side 8*a* and side 8*d* opposite side 8*b*, and similarly define angles C and D respectively with the mounting side. It may be desirable to form the body 4 with different angles A and C, for example 40 and 50 degrees respectively, or with different angles B and D, so that the artisan may rotate the stand 180 degrees for different approach angles.

The mounting side 6 is preferably rectangular in shape, and of sufficient dimensions to adequately support a mounted article holder. The size of the stand, and its mounting side, is selected to fit the needs of the user and the article holders envisioned to be supported. For example, the stand can vary from being small and light in weight for supporting articles such as jewelry to rather large and heavy for supporting such heavy metal articles like automotive starter motors.

Figure 3:
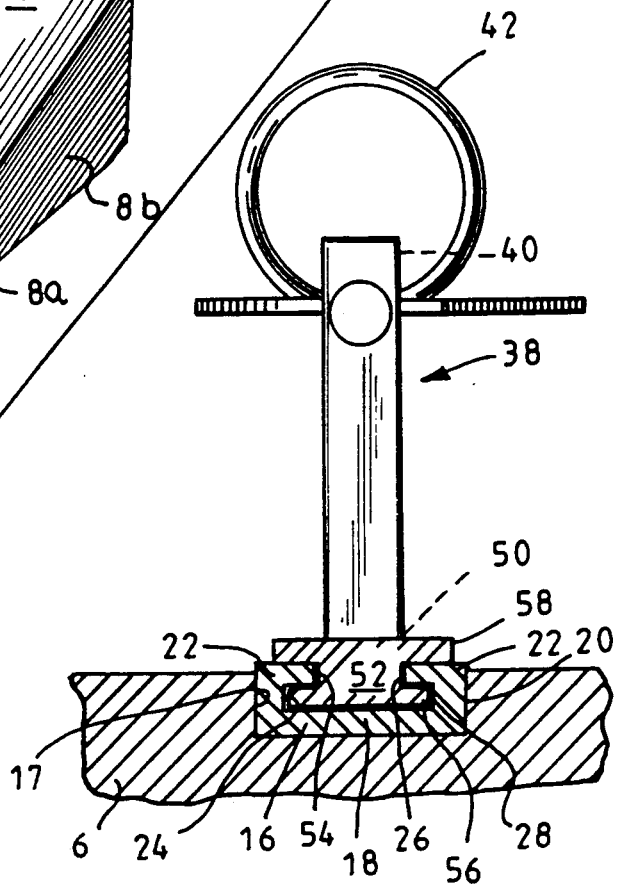
FIG. 3 is a fragmentary top view of the article support stand shown in FIG. 1, with the article holder mounted thereon.

The article support stand 2 further includes a provision for mounting an article holder 14 on the main body 4. In one form of the invention, an elongated bracket 16 having a C-shape in cross-section is mounted in a recess 17 formed in the surface of the mounting side 6 of the body 4. As shown in FIG. 3, the bracket 16 includes a back plate 18, a pair of side plates 20 joined to the back plate 18 on the back plate's opposite transverse edges and extending perpendicularly from the back plate on the same side of the back plate, and a pair of inwardly facing arms 22, each arm 22 being joined to a respective side plate 20 and being spaced apart from the back plate 18.

The C-bracket 16 defines an elongated, T-shaped slot 24, having narrowed and widened portions 26, 28. The narrowed portion 26 of the T-slot 24 is defined between the pair of arms 22, while the widened portion 28 of the T-slot 24 is defined between the back plate 18 and each arm 22.

The bracket 16 is mounted on the main body 4 of the stand 2 with its back plate 18 abutting against the recessed surface of the mounting side 6. Fasteners, glue or other means may be employed to mount the bracket 16 in the recess 17.

The C-bracket 16 mounted in the recessed surface of the mounting side 6 may extend entirely across the mounting side, or may extend from one edge of the mounting side (shown in FIG. 1 as the top edge 30) and terminate before reaching the opposite edge (for example, the bottom edge 32). The terminated edge 34 of the bracket 16 defined by the end of the recess 17 provides a stop, which limits the extent to which an article holder 14 may be received by the bracket 16. This prevents the article holder 14 from inadvertently slipping out of the bracket slot 24 when mounted on the stand 2, and also lets the user know that the holder is fully and properly mounted on the stand.

As mentioned above, at least one end 36 of the bracket 16 extends to an edge of the mounting side 6. Thus, this end 36 is exposed, and is open to the slot 24 so that an article holder 14 may be slidably received by the slot through the exposed open end 36.

Figure 2A:
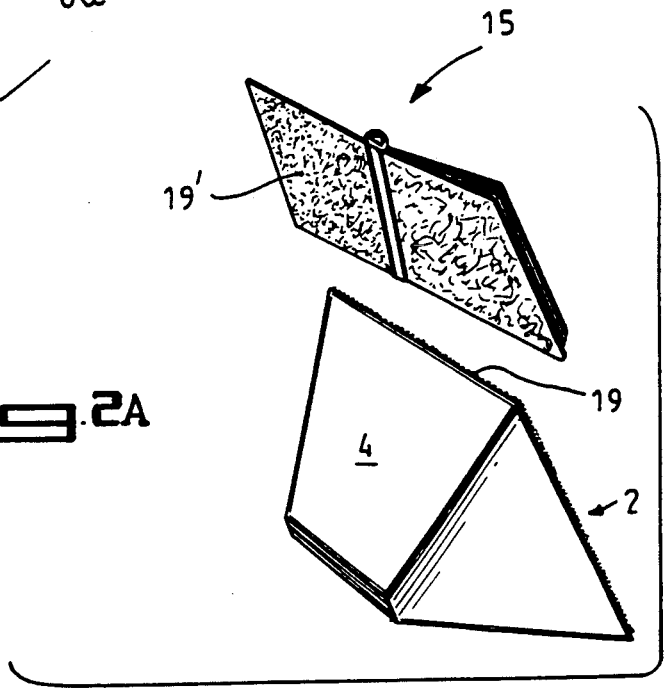
FIG. 2A is a rear perspective view of the article support stand and article holder shown in FIG. 1, illustrating a different form for mounting a holder on the stand.

Referring to FIG. 2A it is observed that the present invention is not limited to the mounting means previously described. FIG. 2A shows the creation of a mutually cooperative mounting device 19. The illustration shows the ability to mount an article holder such as document holder 15 on the stands of the present invention thru the use of Velcro. Such cooperation is achieved by applying an engageable Velcro strip 19 prime to a planar surface of document holder 15 which is designed to cooperate with a mutually aligned Velcro mounting strip 19 on the planar surface, mounting side 6 of stand 2. Upon engagement of the Velcro strips 19 the holder and stand can be repositioned in the same manner as the combination shown in FIGS. 1 and 2.

Thus, the stand may be described as being rotatable about a z-axis of rotation running through the body 4, with the mounting side 6 residing in an x-y coordinate plane that is perpendicular to the z-axis of rotation so that the mounting side of the stand correspondingly turns within the x-y coordinate plane and is adjustable in position within the x-y coordinate plane.

Figure 4:
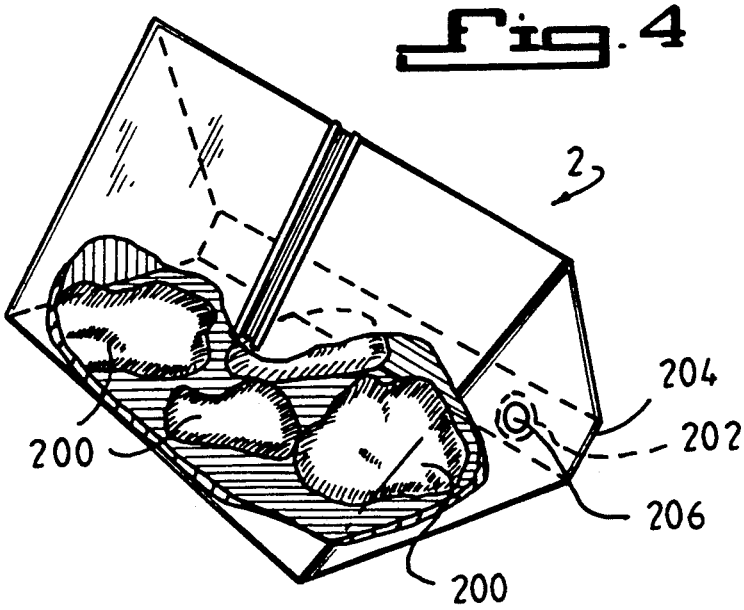
FIG. 4 is a perspective view of an article support stand, partially broken away, formed in accordance with a second form of the present invention.

In another form of the invention, as illustrated by FIG. 4, the article support stand 2 may be hollow, with its sides completely enclosing its interior. An unattached, weighted means 200 is inserted into the hollow interior of the stand and confined within the interior by the stand's sides. The weighted means 200 is movable and will fall to whichever support side the stand is resting on whenever the article stand 2 is repositioned.

Figure 4A:
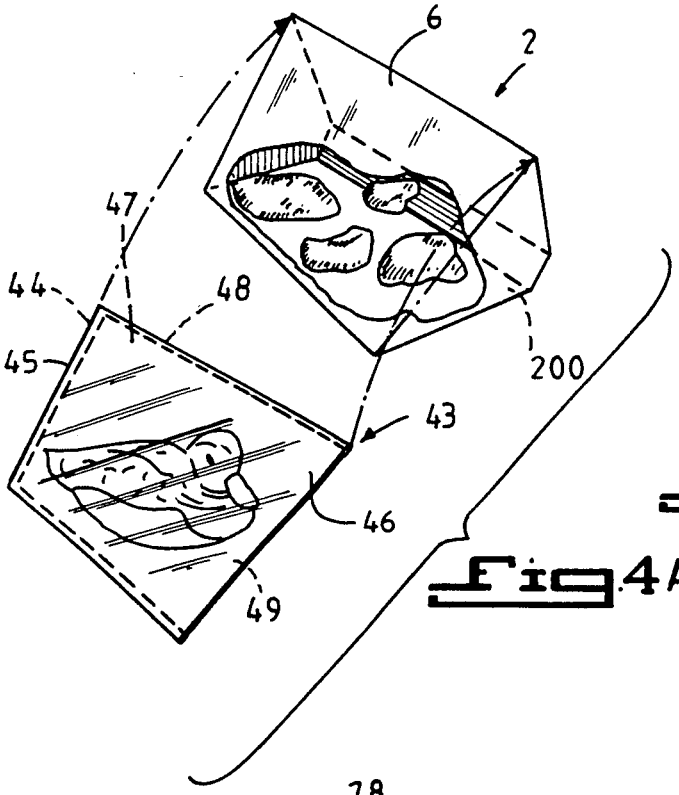
FIG. 4A is an exploded perspective view of an article support stand of the picture stand type, in a landscape view position, partially broken away, formed in accordance with a third form of the present invention.
Figure 4B:
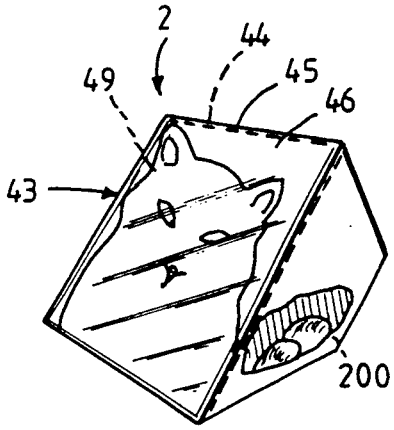
FIG. 4B is a perspective view of the stand shown in FIG. 4A, shown in a portrait view rest position.

In yet another form of the present invention, as illustrated by FIGS. 4A and 4B, an article support stand of the picture holding type may be formed similarly to the stand of FIG. 4 except for one important characteristic. In the exploded view of the stand shown in FIG. 4A permanently affixed article holder means 43 is shown. The mounting device 16 of the former stands is not present. However, as shown in FIG. 4A mounting side 6 consists only of a planar surface which is suitable for the permanent mounting of holder 43. Referring to FIGS. 4A and 4B article holder means 43 is similar to those means utilized in other photograph stands, such as that disclosed in U.S. Pat. No. 2,409,814, which is herein incorporated by reference, for holding a picture in place on the stand. Holder 43 is preferably made of one piece of transparent material and comprises a planar back panel 44, the upper end being turned about upon itself to form a resilient semicylindrical hinge connection 45 and a downwardly directed front planar panel 46. The connection 45 is sufficiently springy to cause the two panels 44 and 46 to be normally urged toward one another. Holder 43 just described is adapted to be mounted on mounting side 6 of those stands of the present invention which have been modified accordingly. Back panel 44 of holder 43 has interior side 47 and exterior side 48. Holder 43 is sized to be smaller than mounting side 6 in length and width dimensions in order to permit it to be easily mounted on mounting side 6 allowing for a margin setback along the entire perimeter of stand 2. As seen in FIG. 4A exterior side 48 is mounted in face to face relationship with mounting side 6 of stand 2 by gluing or, if the holder and stand are both made of a plastic material, other processes known in the art for fusing plastics. Although those skilled in the art will envision many other means for securing holder 43 to stand 2 the present embodiment is economical to manufacture requiring very little modification of the basic stands of the invention. Obviously, in another embodiment, holder 43 and mounting side 6 could be formed to permit side 6 to function similarly to back panel 44, allowing front panel 46 to have the same edges and dimensions of mounting side 6 thereby allowing stand 2 and holder 43 to be formed as one integral unit.

Once article holder 43 is mounted, thereby becoming a permanent part of stand 2, the combination is ready for use. In use, the back and front panels 44 and 46 respectively are spread apart slightly by springing the semicylindrical connection 45 to allow a photograph or other display material 49 to be interposed therebetween. The panels are then allowed to spring back to their initial position to firmly grip and hold the material 49 in display position, as illustrated in FIG. 4B. The stand is thus capable of being reoriented with weighted means 200 being repositioned thereby providing for optimum stability in each new resting position.

These particular embodiments are extremely advantageous in that they allow the center of gravity of an article stand having fixed sides to change to the optimum position thereby preventing a stand from toppling over independent of the forces created by the weight distribution of parts and the angularity of the article which it supports.

Also, the article support stand 2 of FIGS. 4 and 4A, and others to be described, may be manufactured from a plastic or other lightweight material so that most of their weight can be attributed to the movable weight 200. Thus, the article support stand 2 will always maintain a low center of gravity no matter what support side it rests on, further adding to the stability of the stand.

Furthermore, having a movable weight 200 provides for economy of manufacture because the stand may be formed without any real concern for the weight distribution of its parts and how they relate to function.

The weighted means 200 used in the article support stand 2 of FIGS. 4 and 4A may be one of a variety of different materials or objects, including small bags of peas, beans or gravel, loose sand, lead pellets, mercury, water or other liquids. The type of weighted means to be determined by the specific configuration and purpose of the stand. As shown in FIG. 4 the weighted means 200 may be introduced into the interior of the support stand through an access opening 202 formed in one of the sides of the stand (preferably the unused top side 204). The opening 202 may be threaded to receive and secure to the stand a threaded cap 206 which is flush with the outer surface of the top side 204 and, if water is used as the weighted means 200, may be formed to define a watertight closure for the stand.

FIG. 3, in association with FIGS. 1 and 2, illustrates one for of an article holder 14 constructed in accordance with the invention, and demonstrates how that article holder is mounted on the article support stand 2.

A conventional clamp 38, having jaws 40 to hold an article, bearing cap, 42 is modified to further include an elongated rail 52 mounted on the clamp 38, at or near heel 50. The elongated rail 52 has a T-shape in cross-section with narrowed and widened portions 54, 56 that correspond in dimensions to the widened and narrowed portions 28, 26 of the slot 24 defined by the C-bracket 16. The T-rail 52 may include a back plate 58 mounted on the narrowed portion 54 and spaced from its widened portion 56 for mounting the rail on the clamp, such as by welding, gluing, fasteners or other means. In considering another form, the T-rail 52 may be integrally formed with the clamp body when manufactured.

As shown in FIGS. 1 through 3, the clamp-type article holder 14 is removably mounted on the article support stand 2 by sliding its T-rail 52 through the exposed end 36 of the C-bracket 16 into the bracket's T-slot 24 until the article holder is centered on the mounting side 6 or abuts the terminated end 34 of the C-bracket. The C-bracket 16 of the stand 2 securely holds the article holder 14 and supports it at its heel 50.

Thus, the article holder 38 and the article being held 42 may be repositioned by the user to different mounting dispositions, for instance, for changing the disposition of the article being held without manipulating the article holder on the stand 2, simply by rotating the stand 90 degrees so that it rests on a different support side.

Figure 3A:
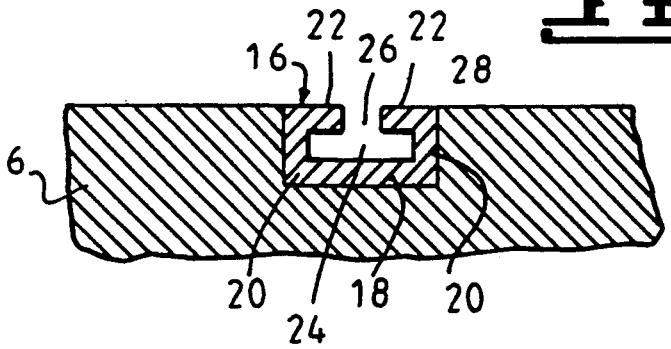
FIG. 3A is a fragmentary sectional view of the article support stand shown in FIG. 1, illustrating one form of the mounting side thereof.
Figure 3B:
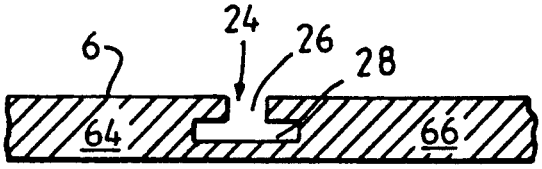
FIG. 3B is a fragmentary sectional view of the article support stand shown in FIG. 1, illustrating another form of the mounting side thereof.

FIGS. 1 through 3 show the C-bracket 16 protruding slightly above the surface of the mounting side 6. It may be desirable to mount the C-bracket 16 flush to the surface of the mounting side 6, as illustrated by FIG. 3A. Of course, it is also envisioned to be within the scope of this invention to eliminate a separate C-bracket member 16 and to form the T-slot 24 directly in the surface of the mounting side 6, as illustrated by FIG. 3B. In such a case, the narrowed and widened portions 26, 28 of the T-slot 24 are defined by first and second portions 64, 66 of the mounting side, the first and second portions 64, 66 being L- shaped and in relative mirror image disposition, as illustrated.

Figure 5:
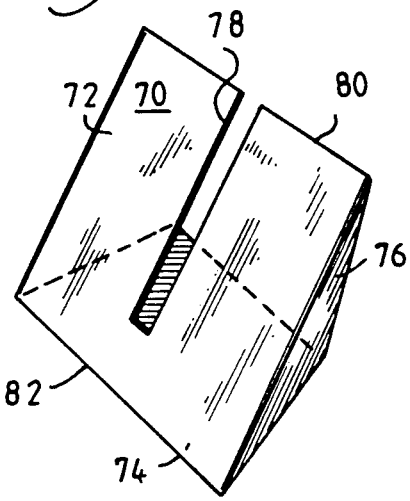
FIG. 5 is a perspective view of an article support stand, constructed in accordance with a fourth form of the present invention.

FIG. 5 illustrates another form of an article support stand, constructed in accordance with the present invention. This alternative form of the stand includes a main body 70 formed as a one-piece, plate-like member bent into three nonparallel, planar dispositions to define three integral sides. One side 72 is the mounting side of the stand; the other two sides are first and second support sides 74, 76. Each of the mounting and support sides 72–76 perform a similar function to that performed by the sides of the stand shown in FIGS. 1 through 4B, and define similar angles A and B therebetween, as in the previous embodiments described.

An elongated slot 78 is formed directly in the mounting side 72 of the plate-like body 70, and extends from the top edge 80 of the stand and across the mounting side 72, and terminates short of the fold 82, as illustrated by FIG. 4. The thickness of the plate surrounding the slot 78 is substantially equal to the space defined between the back plate 58 and the widened portions 56 of the T-rail 52 of the article holder, as shown in FIG. 3, and the width of the slot 78 conforms to the width of the narrowed portion 54 of the T-rail. Thus, the article holder is slidably mountable on the article support stand, with its T-rail 52 being securely captured within the slot 78 formed in the mounting side of the stand.

Figure 5A:
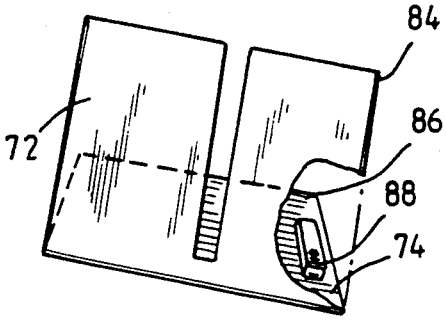
FIG. 5A is a front perspective view, partially broken away, of an article support stand, constructed in accordance with a modification to the form of the invention shown in FIG. 5.

It is evident from the above description that the second support side 76 may be eliminated, as illustrated by FIG. 5A, with the possible sacrifice of some stability to the stand. The modified stand would then be comprised of the mounting side 72 and the first support side 74. The side edges 84, 86 of the mounting side 72 and the first support side 74 constitute the support for the stand when it is rotated 90 degrees from the position shown in FIGS. 5 and 5A, so that the stand rests on these edges 84, 86.

As in the other embodiments, the first and second support sides 74, 76 of the stand of FIG. 5 define a 40 degrees angle with the mounting side 72 so that the mounting side is disposed at a substantial angle to the workbench or table top. In the modified stand of FIG. 5A, the side edge 86 of the first support side 74 resides in a plane which defines a 40 degree angle with the mounting side 72.

To increase stability of the edge supported stand shown in FIG. 5A, a weight 88 may be added. The weight 88 is mounted on the first support side 74 near its side edge 86. The weight 88 lowers the center of gravity of the stand when it is disposed on its side edge, and minimizes the chance of the stand toppling under the weight of the article holder.

Figure 6:
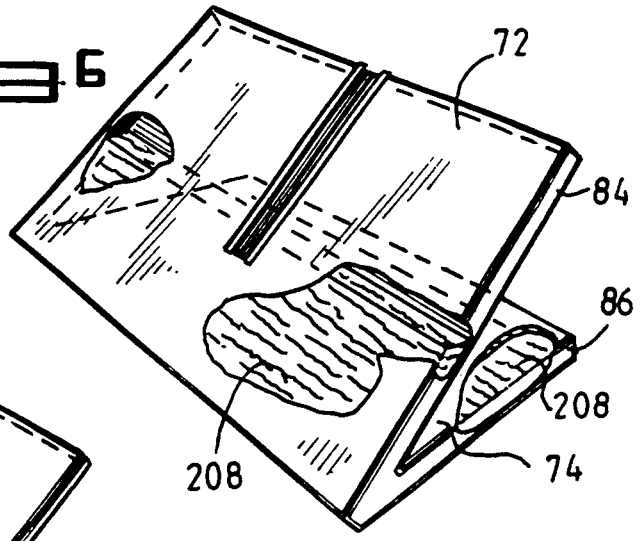
FIG. 6 is a perspective view of the article support stand shown in FIG. 5A, partially broken away, modified in accordance with another embodiment of the present invention.
Figure 6A:
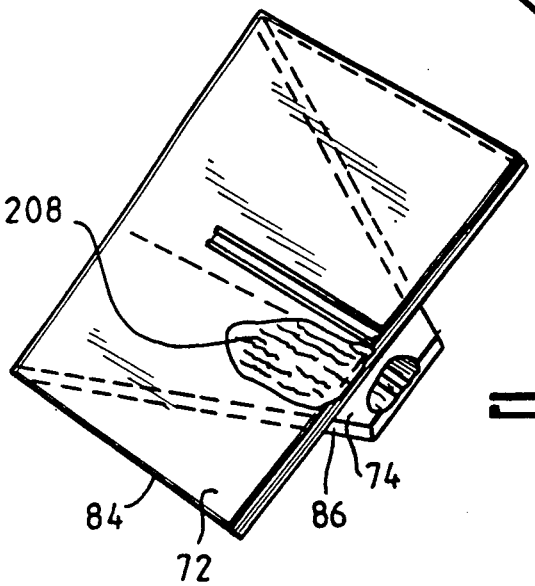
FIG. 6A is a perspective view of the stand shown in FIG. 6, shown in a different rest position.
Figure 6B:
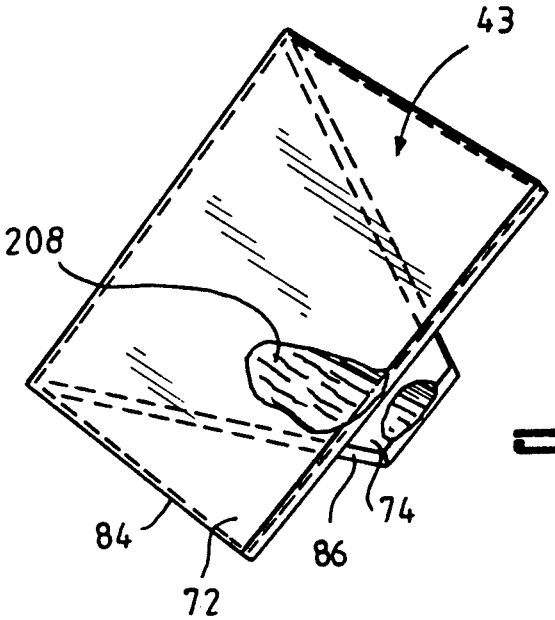
FIG. 6B is a perspective view of the article support stand shown in FIG. 6A, partially broken away, modified in accordance with another picture stand embodiment of the present invention.

Alternatively, the stand of FIG. 5A may be made of hollow sides 72, 74, as shown in FIG. 6, to receive and retain a moveable ballast 208 or weight, such as water or loose sand. The hollow interiors of each side 72, 74 may be in communication to allow the moveable ballast 208 to flow from one side to the other. The loose ballast partially fills the interior of each side and thus occupies the lower interior portion of each side. When the stand is repositioned, as shown in FIG. 6A, the water or sand will shift accordingly and will help hold the stand upright in the new position. Furthermore, as seen from the forgoing description of stand 2 shown in FIGS. 4A and 4B, permanently affixed article holder 43 may also be similarly formed for the embodiment shown in FIG. 6B allowing the center of gravity to shift with each new disposition of the stand. The same feature of hollow sides containing a moveable ballast may be incorporated in the stand shown in FIG. 6, described previously, as well as that shown in FIG. 6B.

Figure 7:
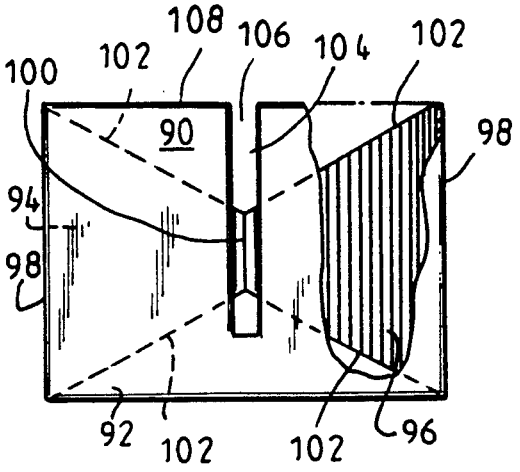
FIG. 7 is a front elevational view, partially broken away, of an article support stand, constructed in accordance with a fifth form of the present invention.

FIG. 7 shows another form of the article support stand, and combines the features of the stands shown in FIGS. 1 through 3 and FIGS. 4 and 5 as well. The stand includes a body 90 having an overall pyramid or truncated pyramid geometric shape, as with the first stand described (FIGS. 1-3), but which is only three sided and edge supported in one of its dispositions, as well as being formed from a bent plate-like member, as in a previous embodiment of the stand and its modification (FIGS. 5 and 5A).

The main body 90 of the stand includes a rectangular, planar mounting side 92 (the base of the pyramid configuration), and two planar support sides 94, 96 joined to the opposite edges of the mounting side. Each support side 94, 96 defines with the mounting side 92 an acute angle, preferably about 40 degrees, along the opposite edges 98 of the mounting side. The support sides 94, 96 extend from the mounting side 92 on the same side of the plane in which the mounting side resides, and mutually converge towards the rear of the stand to join each other and define a back edge 100.

Each support side 94, 96 is trapezoidal in shape, and includes exposed side edges 102. These side edges 102 are used to support the stand on a workbench or table top, as exemplified by the disposition of the stand shown in FIG. 7. The side edges 102 of the support sides 94, 96 preferably reside in planes which define angles of 40 degrees with the mounting side 92, so that the mounting side 92 is disposed at the same angle with respect to the workbench or table top with the stand in any user selectable disposition. Alternatively, as in the embodiment shown in FIGS. 1 through 3, the angles of the support sides 94, 96 and side edges 102, with respect to the mounting side 92, may be selected to provide different mounting angles for different dispositions of the stand thereby adding a great amount of versatilty to both the stands and article holders.

As in the stand shown in FIGS. 5 and 5A, the stand of FIG. 7 has an elongated slot 104 formed in its mounting side 92, with an open end 106 of the slot disposed at the mounting side's top edge 108. The elongated slot 104 is dimensioned to receive the T-rail 52 of an article holder, such as that of the holder described previously and shown in FIG. 3.

Figure 7A:
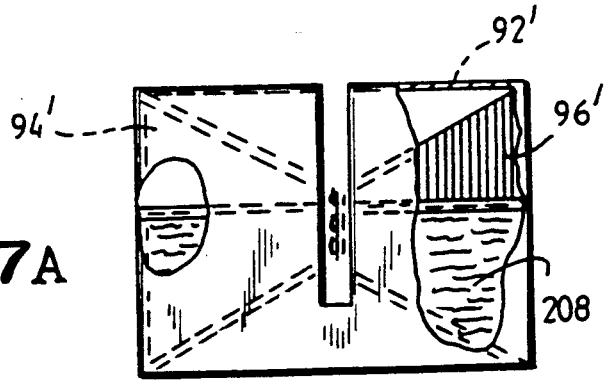
FIG. 7A is perspective view of a modification of the stand shown in FIG. 7 including means to change the center of gravity.
Figure 7B:
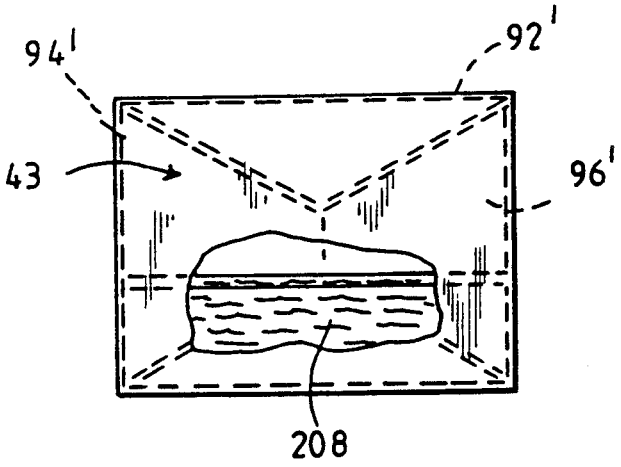
FIG. 7B is a perspective view of a modification of the stand shown in FIG. 7A showing a stand having a holder for display material integrally formed with the stand.

The stand of FIG. 7 can be rotated to rest on either of the support sides 94, 96, or on the exposed edges 102 of the support sides, so that the slot 104 will be either vertically or horizontally disposed. An article holder thus received by the slot and secured to the mounting side 92 of the stand is displayable in different dispositions without manipulating the article holder on the stand, bymerely rotating the stand so that it rests on its support sides 94, 96 or the side edges 102 of the support sides. Referring to FIGS. 7A and 7B additional embodiments of the stand shown in FIG. 7 are disclosed. The stand of FIG. 7A includes hollow sides 92', 94' and 96' which provide for the movement of weight means 208 thereby changing the center of gravity when the stand is placed in different dispositions. The stand of FIG. 7B is similarly constructed, however, as previously described, the article holder means 43 is integrally formed with the stand thereby eliminating slot means 104.

Referring now to FIGS. 8 and 9, a fourth form of an article support stand, constructed in accordance with the present invention, is shown. In this form of the invention, an article holder may be suspended above the workplace and may be adjusted both in mounting angle and in its rotation.

The article support stand first includes a conventional, double-arm multi-function support bracket 110. Such brackets are typically used for supporting a swing arm type lamp over a workbench top, drafting table or the like, and are usually mounted at the edge of the workbench or table. Such a support bracket is used on the swing-arm lamp Model No. 173-7500, manufactured by Electrix, Inc.

The support bracket 110 includes a pinion 112 which is rotatably held by a sleeve 114. A knob 116 can adjust the pressure that the sleeve 114 exerts on the pinion 112 and the degree to which the pinion is rotatable.

The sleeve 114 is clamped between two side brackets 118, so that the sleeve, and the pinion 112 held by the sleeve, are angularly adjustable from the vertical. The angular disposition of the pinion 112 selected by the user may be maintained by tightening the knob 116, which increases the side brackets' holding force on the sleeve 114.

The pinion 112 includes a flange 120 mounted on its free end. Holes 122 are formed on the flange 120 for receiving screws or other fasteners for mounting a lamp or other object to the support bracket.

In the present invention, a planar plate-like member 124, rectangular in form, is mounted on the flange 120 of the support bracket 110. The plate-like member 124 includes a front side 126, constituting the mounting side of the article support stand, and an opposite rear side 128, to which the flange 120 of the support bracket is attached.

As in the other previously described embodiments, the article support stand of FIGS. 8 and 9 includes a provision for mounting an article holder to the stand. The same forms of the article holder mounting structure used in the other stands of the invention may be employed here. For example, the C-bracket 16 shown in FIG. 3 may be mounted on the surface of the mounting side 126 of the plate-like member 124, or mounted flush to the surface in a recess formed in the mounting side 126. Alternatively, as exemplified by FIG. 3B, a T-slot 24 may be formed directly in the member and defined by L-shaped member portions 64, 66.

As a further alternative, the member 124 may be a relatively thin plate formed with an elongated slot, as employed in the stands of FIGS. 5 and 5A, with the mounting flange 120 of the support bracket 110 being positioned on the rear side of the member so as not to interfere with the slot.

Depending on the means employed to define the slot 24 in the member, the slot may be open at an edge 80 of the member so that the corresponding T-rail 52 of an article holder, such as that previously described and shown in FIG. 3, may be slidingly received by the slot 24 and secured to the mounting side 126 of the stand.

The article support stand of FIGS. 8 and 9 provides different angles of mounting for the user by loosening the knob 116 and adjusting the member 124 up or down, as illustrated by arrows A in FIG. 9. As shown in FIG. 10, an article holder 14, holding bearing cap 42, secured in the slot 24 on the mounting side 126 of the stand may be rotated to different mounting dispositions (by the pinion 112 turning in the sleeve 114, as indicated by arrow B), for example, the different positions shown in FIGS. 8 and 9, so that the user may quickly and efficiently adjust the disposition of the article being held without manipulating the article holder on the stand.

However, unlike the previous stands discussed where the direction of the z-axis of rotation is dependent on the angularity of the stand's fixed sides when placed on a horizontal support surface, the stand shown in FIGS. 8, 9 and 10 provides an additional capability. Referring to the present illustrations it is observed that the z-axis of rotation is positionable in any direction when considering the cooperation of multi-function support bracket 110, pinion 112, and plate-like member 124. Therefore the combination may be described as further including the ability to position, or direct, the z-axis in space.

Furthermore, somewhat like the stand of FIG. 1, the stand shown in FIGS. 8, 9 and 10 may be described as being rotatable about a z-axis of rotation running through the plate-like member 124, with the front or mounting side 126 residing in an x-y coordinate plane that is perpendicular to the z-axis of rotation so that the mounting side of the stand correspondingly turns within the x-y coordinate plane and is adjusted in position within the x-y coordinate plane. Referring to FIGS. 8, 9 and 10 however, stand 2 may be further described as being positionable about additional axes. It is observed that the stand is rotatable about an x-axis of rotation running through pinion 112, in a plane parallel to the plane going thru sleeve 114 and knob 116 of bracket 110, with the front or mounting side residing in y-z coordinate plane that is perpendicular to the x-axis of rotation so that the mounting side of the stand also turns within the y-z coordinate plane and is adjusted in position within the y-z coordinate plane. Furthermore, with the further cooperation of a standard desk mounted support bracket, not shown, of multi-function support bracket 110 the stand is also rotatable about a y-axis of rotation thereby positioning mounting side 126 in an x-z coordinate plane. Thus the stand of FIGS. 8, 9, and 10 is capable of being universally positionable in the x-y, y-x, and x-z coordinate planes. Consequently, the z-axis shown in FIGS. 8, 9, and 10 may be referred to as being a universally positionable z-axis of rotation.

FIGS. 11 through 15 illustrate the versatility of the article support stands and document holders, with their interlocking T-slots and T-rails, and the applicability of the concepts of the present invention to other forms of article holders, constructed in accordance with the present invention.

For example, FIG. 11 shows a threaded rod article holder 170, having a threaded rod 171 mounted on base 172. The rod 171 is provided to hold an article 174, such as a statue, having a complementary female threaded receiving means, to the holder.

The holder includes a T-rail 52, such as previously described, mounted on its base. The T-rail 52 interfits with the T-slots 24 formed in the article support stands of the invention so that the threaded rod article holder 170 may be supported by the stands in a variety of positions.

FIG. 12 shows a heat sink article holder 175 having a heat sink clamp means 176, mounted on base 177, interfitted with a T-rail member 52, as described previously. Like the threaded rod holder of FIG. 11, the heat sink article holder may be removably secured to any one of the article support stands previously described.

FIG. 13 shows a motorized drill-type article holder 180 having a motorized tool body 181, mounted on base 182, also interfitted with a T-rail member 52. It is envisioned, as previously mentioned in describing article holder 14, that T-rail member 52 may be integrally formed in the article which forms the body of the holder thereby merging base 182 and back plate 58 of T-rail 52 and body 181. Thus the article holder includes a T-rail 52 thereby enabling it be be mounted on the article support stands described herein.

Additionally, FIG. 14 shows a document holder 185 having a T-rail member 52 fitted to spine 186. Lastly, FIG. 15 shows a mirror-type holder 190 having mirror 191 with a T-rail member 52 mounted on mirror back 192.

Because the article support stands and article holders of the present invention employ conforming T-slots +and T-rails, the user is provided with the free interexchange of holders and stands, so that he may select any combination of stand and holder to fit his needs.

In most instances, the article support stands of the present invention, in their various described forms, will securely hold the article holder on the stand's mounting surface in no matter what position the stand is placed. This is primarily because the T-rail and C-bracket of the holder and stand, respectively, may be made to frictionally interfit.

It is possible, however, as with the stand shown in FIG. 1, for the T-rail 52 to inadvertently slide out of the open side 36 of the C-bracket 16 if the document stand is positioned with the open side down, and if the T-rail loosely slides in the C-bracket. Accordingly, it may be advantageous to provide the article support stand and holder with a latching or locking mechanism, to ensure that the article holder remains secured to the stand until intentionally removed.

One form of latching mechanism is illustrated by FIG. 16 of the drawings. The C-bracket 354 mounted on the article support stand 356 or, if no C-bracket is used (as in the embodiment shown in FIG. 3B), the inwardly set wall of the mounting side that defines the T-slot, may be formed with a triangular-shaped recess 358, thus defining an abrupt shoulder or stop surface 360, and a gradually inclined surface 362, formed in the bracket or mounting side, as the case may be.

The stop surface 360 is situated more proximate to the open end 364 of the C-bracket or T-slot, and the inclined surface 362 is situated more distal to the open end. The inclined surface 362 and stop surface 360 define the hypotenuse and a side of the triangular-shaped recess 358, respectively.

Similarly, a wedge-shaped member 366 is mounted on the widened portion 56 of the T-rail 52 of the article holder 365. The wedge-shaped member 366 conforms to the shape of the triangular recess, and also includes an inclined surface 368 and a stop surface 370, the stop surface 370 being situated more closely to the end of the T-rail 52 than the inclined surface 368.

When the article holder 365 with its T-rail 52 is slid into the open end of the C-bracket 354 or T-slot of the article support stand 356, the wedge member 366 will be received by the recess 358. The T-rail 52 may be formed to be somewhat resilient, and when properly mounted on the C-bracket 354 or T-slot such that its wedge 366 is in alignment with the recess 358, the wedge will be biased toward and resiliently snap into the recess, with the stop surfaces 360, 370 of each facing each other. The article holder is thus locked in position on the mounting side of the article support stand. It cannot inadvertently slide out the open side 364 of the C-bracket or T-slot, because the two stop surfaces will engage each other and prevent this.

To remove the article holder from the support stand, one merely has to lift the end of the T-rail 52 closest to the open end 364 of the C-bracket or T-slot until the stop surface 370 of the wedge member 366 is lifted clear of the stop surface 360 of the C-bracket 354 or T-slot. The article holder may then be removed from the stand.

To ensure that the wedge member 366 may be completely lifted out of the recess 358, the inwardly facing arms 22 of the C-bracket 354, or the area of mounting side defining the narrowed portion 26 of the T-slot, as shown in FIG. 3B, is removed over a portion 372 of its length residing above the recess 358, as shown in FIG. 16. This will prevent the C-bracket or mounting side defining the T-slot from interfering with the upward movement of the T-rail 52 to disengage the wedge member 366 from the recessed portion of the C-bracket 354 or mounting side walls.

Also, the T-rail 52 may be made to be more resilient with the structure shown in FIG. 16. The back plate 58 of the rail is joined to the widened portion 56 of the rail by narrow portion 54. Narrow portion 54 need not extend over the full length of the T-rail 52, as shown. Rather, it may extend over a portion of the rail away from the portion carrying the wedge member 366, so that the back plate 58 and widened portion 56 are unjoined in the vicinity of the wedge member. This structure allows the end of widened portion 56 of the T-rail 52 to be flexed so that the wedge member 366 may be lifted free of the recess 358.

The widened portion 56 may also be made to be slightly longer than the back plate 58 so that it extends slightly beyond the open end 364 of the C-bracket 354 or T- slot. This allows one to easily lift the widened portion 56 with one's finger to disengage the wedge member 366 from the recess 358.

FIG. 17 illustrates another form of a latching mechanism. As shown in FIG. 17, the C-bracket 16 (or the mounting side portions defining the T-slot) may have a series of spaced apart detents or grooves 374 formed in the underside surface of arms 22 or portions 64, 66 which define the narrow portion of the slot. The grooves 374 extend transversely to the longitudinal direction of the T-slot or C-bracket.

The T-rail 52 may include a series of spaced apart protrusions or rounded formations 376 situated along its length on the top side of widened portion 56. Like the grooves 374 formed in the C-bracket, the protrusions 376 extend transversely to the longitudinal axis of the rail. The narrowed portion 54 of the rail 52 may be provided in sections to allow the protrusions 376 to extend across the entire top surface of the widened portion 56.

When the T-rail 52 is inserted into the open side of the C-bracket 16 or T-slot, the protrusions 376 engage the grooves 374. The article holder 378 is thus held in place on the support stand 380 until sufficient force is exerted to disengage the protrusions from the grooves and dismount the holder from the stand. This form of the invention is advantageous in that it allows the article holder to be latched in place at different levels on the mounting side 6 of the stand, as different protrusions 376 may be selected to engage different grooves 374. Of course, it is envisioned to form the T-rail 52 with protrusions 376 on the bottom side of widened portion 56, and to form the grooves 374 in the back plate 18 of C-bracket 16 or the inside back surface of the mounting side defining a T-slot, as in FIG. 3 B (if no C-bracket is used), with comparable results. Also, the positions of the protrusions and recesses may be reversed, that is, the recesses 374 may be formed on the T- rail 52, and the protrusions 376 may be formed on the C- bracket 16 or mounting side 6.

Figures 18, 19, 20, 20A:
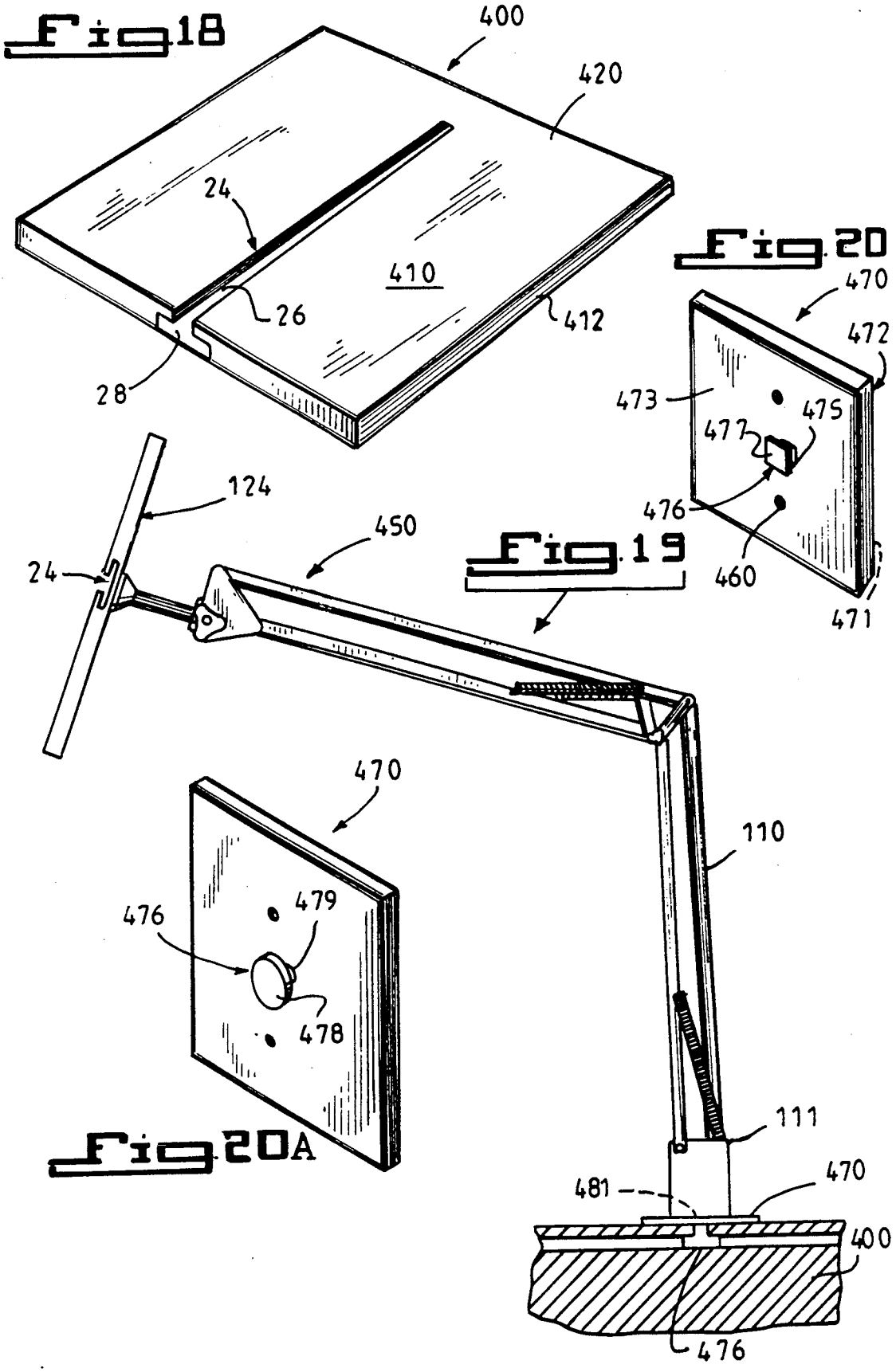
FIG. 18 is top perspective view of an article support stand formed in accordance with the present invention.
FIG. 19 is a perspective view, partially in section, of a mounted, suspended adaptor formed in accordance with another form of the present invention.
FIG. 20 is a bottom perspective view of a cooperating adaptive member formed in accordance with the present invention.
FIG. 20A is a bottom perspective view of another form of cooperating adaptive member formed in accordance with the present invention.

In another embodiment of the present invention it is also envisioned to form an article support stand with a single slot defining means and which is capable of holding one or several suspended adaptors in a plurality of different positions, all suspended adaptors being mounted on the stand by using the same slot. The adaptor allowing for the spacial positioning of article holders on an article support stand. Such a stand 400 is shown in FIG. 18. Basically, the stand includes a plate-like member 410 having a mounting side 420 with a slot defining means, such as a C-bracket mounted on it at its mounting side, as described previously in relation to the stand shown in FIG. 3A, or having a T-slot 24 formed directly in mounting side 420, such as described in relation to the stand shown in FIG. 3B.

The adaptor, or adaptive article holder 450, includes a suspended arm having plate-like member at its suspended end and a cooperating base member at its support end. Part of the adaptor can be somewhat similar to the stand shown in FIGS. 8, 9 and 10. Referring to FIG. 19 it is observed that stand 400 has mounted thereon adaptor 450 which comprises: plate-like member 124 having an article holder mounting means such as T-slot 24, a suspended arm, such as support bracket 110, and a cooperating adaptive member 470 for mounting the adaptor on stand 400. When considering the stand of FIG. 8 previously discussed, the adaptor provides for additional capabilities. The adaptor 450 has the additional feature of being slidably mountable on the article support stand described above. FIG. 20 shows cooperating adaptive member 470 which is provided with a planar plate-like base 472 having a support side 471 opposite cooperating side 473. Support side 471 is provided for attaching the foot 111 of support bracket 110. The attachment via screws 460 or the like could be permanent or removable. A removable feature can be achieved by providing cooperating adaptive member 470 with an apperture 481 to receive a projecting member from bracket 110. Such means are known in the art and are used with clamps for attaching support brackets for lamps, copyholders and the like to the surface edges of tables or desks. Once again, referring to FIG. 20 cooperating side 473 of member 470 is observed. The cooperating member can take a plurality of different forms. T-rail 52, similar to the other rails described previously in relation to the other embodiments of the invention, may be utilized. However, the T-rail concept may also be constructed in different forms. As shown in FIG. 20, the cooperating side 473 has T-rail 476 which has a narrowed portion 475 joined to a widened portion 477. Additionally, the widened portion 477 of the T-rail 476 has a width and length which are substantially equal to each other and which are equal to or slightly smaller than the widened portion 28 of the T-slot formed in the stand. Similarly, the narrowed portion 475 of the T-rail has a width and length which are substantially equal to each other and which are equal to or slightly smaller than narrowed portion 26 of the T-slot. This configuration of the T-rail will allow the widened portion 477 to be inserted either lengthwise or sidewise into the T-slot 24 of stand 400.

Accordingly, the T-rail 476 may be formed with a square-shaped widened portion 477, as shown in FIG. 20. A cooperating member 470 having the square-shaped T-rail mounted on it is thus positionable on the mounting side of the stand in four different dispositions, depending on how the T-rail is inserted into the T-slot. Because of the square-shape of the T-rail the base 472, once mounted on the stand, in cooperation with a rigidly mounted support bracket 110, cannot rotate relative to the stand, and will be maintained in that particular disposition selected at the time it is mounted, until it is removed, turned to a different disposition and remounted on the stand. This particular embodiment creates the ability to mount one or more suspended adaptors, using a stand having only one mounting device, in a number of selectably fixed dispositions on the stand.

Alternatively, the T-rail 476 of cooperating member 470 may be formed with a circular widened portion 478 and a concentrically disposed circular narrowed portion 479, as shown in FIG. 20A. Like the square-shaped embodiment described above, the circular widened portion 478 of the T-rail has a diameter which is equal to or slightly less than the width of the widened portion 28 of the T-slot 24 and the circular narrowed portion 479 of the T-rail has a diameter which is equal to or slightly less than the width of the narrowed portion 26 of the T-slot so that the T-rail may be received by the T-slot in any disposition of the T-rail. This allows the T-rail to be rotatable in the T-slot.

A suspended adaptor having the circular T-rail mounted on its base member is thus positionable on the mounting side of the stand in an infinite number of dispositions. When mounted on the stand, the adaptor may be rotated to a different disposition, even though it is securely mounted on the stand. Additionally, as in the previously described combination, the circular T-rail and stand combination provides for the mounting of a number of adaptors, at the same time, using the same mounting means with such adaptors having individual and separate capabilities if desired.

Figure 21:
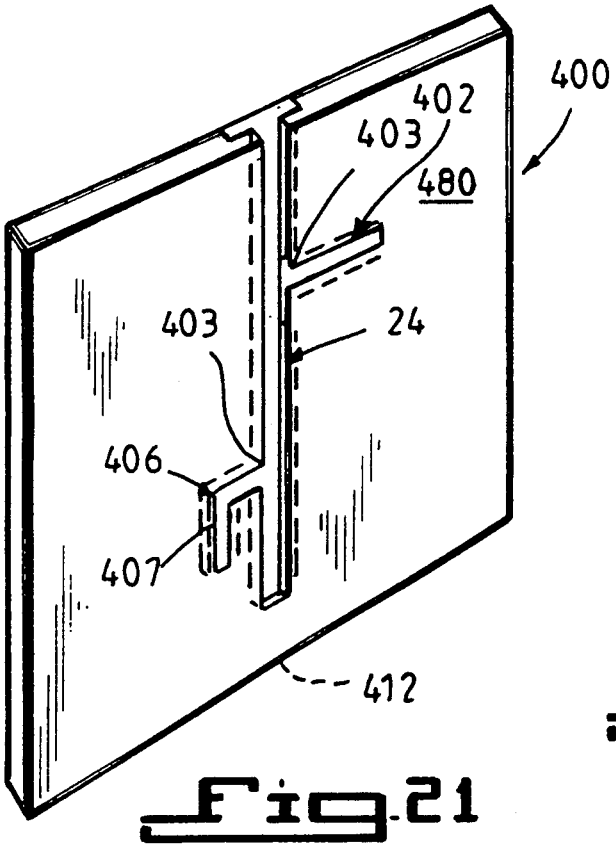
FIG. 21 is a front perspective view of the article support stand shown in FIG. 18, positioned vertically, and modified for holding an adaptive member in a fixed position.
Figure 22:
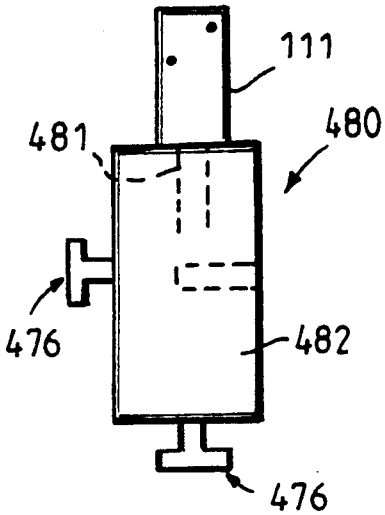
FIG. 22 is a bottom perspective view of yet another form of cooperating adaptive member formed in accordance with the present invention.
Figure 23:
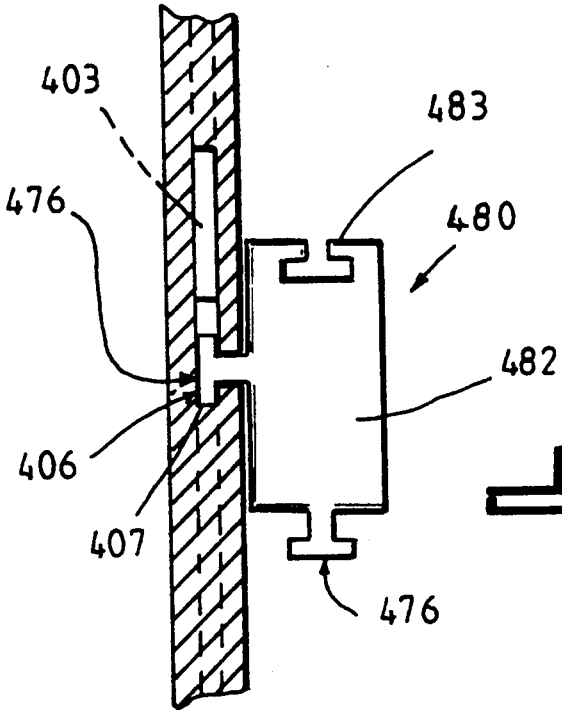
FIG. 23 is a fragmentary side view of the article support stand shown in FIG. 21, with an adaptive member mounted thereon.

Additional improvements of the adaptor concept follow. Referring to FIG. 21, in association with FIGS. 22 and 23, stand 400, as previously described, is illustrated in a different disposition. When stand 400 is placed vertically, having edge 412 in the horizontal, slot 24 of stand 400 will also be vertically disposed. Additional features may be desirable when slot 24 is so oriented. FIGS. 22 and 23 show adaptive member 480 which is envisioned for maintaining the vertical positioning of base 111 of suspended adaptor 450 when stand 400 is also vertically oriented. Adaptive member 480 is formed with a base 482 which differs in shape from base 472 previously described. Base 482 is a rectangular solid having sufficient vertical height and surface area to support an additional cooperating T-rail 476 projecting perpendicularly from at least one side. Adaptive member 480 also provides for the removable mounting of an attached device via the cooperation of a rail member and T-slot 483 situated at the top of member 480 when the member is vertically mounted.

Referring to FIGS. 21 and 23, once again, it is observed that side slot 402 allows for positioning and maintaining mounted adaptive member 480 at a specific height or location accessable to, but removed from, the path of slot 24. Side slot 402 is created by providing T-slot 24 with a perpendicularly intersecting T-slot of similar size and shape. Slot 402 intersects slot 24 at mutual opening 403 which is provided along a side wall of slot 24. An alternative form of side slot 402 is also illustrated. Stop slot 406 is L-shaped and joined to slot 24 as described above with one end of the L-shaped slot communicating with slot 24 and with its other end closed and forming trapper corner 407. Trapper corner 407 is positioned lower than opening 403 when stand 400 is vertically oriented. Trapper corner 407 of L-slot 402 provides a firm holding means for the cooperating rail of adaptive member 480 (and 470 as well) preventing any lateral or longitudinal movement unless deliberately lifted. It should also be noted that slots 402 and 406 provide a stop means for allowing adaptors 470 and 480 to be held at one vertical position without the need for additional mechanical means. Additionally, thru the cooperation of slots 402 and 406, slot 24 is provided with the further ability of holding and repositioning additional devices along its path without the need for removing the devices from stand 400.

Thus, a stand having a single slot may be used to mount one or more article holders and or adaptors, having a variety of T-rail forms, allowing the mounted devices to be positioned in a plurality of mounting dispositions.

The article support stands and article holders of the present invention allow the user to support an article holder on a stand he selects and position the article holder in multiple positions for different reading patterns.

The article support stands may be formed from a plastic or other synthetic material, as well as sheet metal or wood. The T-rails 52 and C-brackets 16 may be inexpensively formed of an extruded plastic material.

As is evident from the structures described and shown in the drawings, the article support stands are mechanically simple, with few components, and easily manufactured, and each is adapted to receive and hold a article holder in a number of mounting dispositions.

Although illustrative embodiments of the present invention have been described herein with reference to the accompanying drawings, it to be understood that the invention is not limited to those precise embodiments, and that various other changes and modifications may be effected therein by one skilled in the art without departing from the scope or spirit of the invention.

I claim:

1. An adaptor for coupling an article holder to an article support stand, the adaptor comprising:

first means for removably mounting an article holder on the adaptor;

second means for removably mounting the adaptor to the article support stand;

wherein one of the first and second means includes means defining an elongated slot; and wherein the other of the first and second means includes a rail member;

means for supporting the first and second means;

wherein the means for supporting the first and second mounting means includes a suspended arm, the arm including a first end on which the first means is situated, and a second end on which the second means is situated and pivoting means for adjusting the position of the article holder with respect to the stand.

2. In combination:

an article support stand for removably mounting an article holder thereon, and a suspended article holder support device adapted to be mounted on the article support stand;

the article support stand including a main body, the main body having a mounting side, and means for mounting the suspended article holder on the mounting side of the body, the article holder mounting means including means defining an elongated slot situated on the mounting side of the body for mounting the article holder on the mounting side;

the suspended device including first means for mounting a planar, plate-like body on the device;

the planar body having a front mounting side and a rear side opposite the front side, means for rotatably supporting the plate-like body and for positioning the body in a selectable angular disposition about a z-axis of rotation, the body being mounted on the body supporting means on the rear side thereof, the body supporting means being situated on the first mounting means, and third means for removably mounting an article holder, the third article holder mounting means being situated on the planar body at the mounting side thereof, the article holder mounting means being selectively engageable with the article holder, wherein the body may be rotated on the supporting means to position the mounting side and an article holder mounted thereon in one of a number of selectable positions, the mounting side residing in an x-y coordinate plane which is perpendicular to a z-axis of rotation, the plate-like body being adapted to be rotated about the z-axis of rotation so that the mounting side thereof is correspondingly turned within the x-y coordinate plane and adjusted in position within the x-y coordinate plane;

the suspended article holder device further including second means for removably mounting the suspended device to the support stand, the second means of the suspended device being engageable with the mounting means of the stand to allow at least one suspended device to be mounted on the article support stand.

3. In combination:

an article support stand for removably mounting an article holder thereon, and a suspended article holder support device adapted to be mounted on the article support stand;

the article support stand including a main body, the main body having a mounting side, and means for mounting the suspended article holder on the mounting side of the body, the article holder mounting means including means defining an elongated slot situated on the mounting side of the body for mounting the article holder on the mounting side;

the suspended device including first means for supporting a planar, plate-like body on the device;

the planar body having a front mounting side and a rear side opposite the front side, the body being attached to the first support means, and third means for removably mounting an article holder, the third article holder mounting means being situated on the planar body at the mounting side thereof, the third article holder mounting means being selectively engageable with the article holder;

the suspended device further including second means for removably mounting the suspended article holder device to the support stand, the second means of the suspended device being engageable with the mounting means of said stand to allow at least one suspended device to be mounted on the article support stand.

4. A combination as defined by claim 3, wherein the third article holder mounting means includes means defining an elongated slot situated on the mounting side of the planar body, the slot defining means forming the slot with a substantially "T" shape in cross-section, and with a narrowed portion and a widened portion communicating with the narrowed portion.

5. A combination as defined by claim 3, wherein the suspended article holder device further includes pivoting means for adjusting the position of the suspended article holder device with respect to the stand.

6. In combination:

an article holder, and an article support stand for removably mounting the article holder thereon;

the article support stand including a main body, the main body including a mounting side, a first support side and a second support side, the mounting side having at least first and second edges disposed transversely to each other, the first support side being joined to the mounting side at the first edge thereof, the second support side being joined to the mounting side at the second edge thereof, each of the mounting side and the first and second support sides being substantially planar, the first and second support sides extending angularly from the mounting side on the same side of the plane in which the mounting side resides, the first support side and the mounting side defining therebetween an acute first angle at the first edge, the second support side and the mounting side defining therebetween an acute second angle at the second edge; and means for removably mounting the article holder, the article holder mounting means being situated on the body at the mounting side thereof to allow the article holder to be mounted on the mounting side, the stand being selectively positionable to rest on one of the first support side, thereby supporting an article holder mounted thereon in a first mounted position, and the second support side, thereby supporting an article holder mounted thereon in a second mounted position which is transverse to the first viewing position, the mounting side residing in an x-y coordinate plane which is perpendicular to a z-axis of rotation, the article support stand being adapted to be rotated about the z-axis of rotation so that the mounting side thereof is correspondingly turned within the x-y coordinate plane and adjusted in position within the x-y coordinate plane;

wherein the main body defines a hollow interior space; and which further comprises weighted means disposed in the interior space of the main body, the weighted means being adapted to move within the interior space of the body whenever the article support stand is repositioned from one of the first and second support sides to the other of the first and second support sides so as to help lower the center of gravity of the article support stand;

the article holder including means for holding an article, means for supporting the article holding means, the article holding means being mounted thereon, and means mounted on the article holding support means for engageably cooperating with the article holder mounting means of the article support stand.

7. A combination as defined by claim 6, wherein the article holder is a clamp-type holder.

8. A combination as defined by claim 6, wherein the article holder further includes an electrified device permanently attached to the article holding means of said holder.

9. A combination as defined by claim 6, wherein the means for supporting the article holding means of said holder includes a planar, plate-like member.

10. A combination as defined by claim 9, which further includes a mirror permanently attached to the article holding means of said holder.

11. A combination as defined by claim 6, wherein the article holding means of said holder is a rod, the rod having cooperating means for engaging a mutually cooperating means of an article.

12. A combination as defined by claim 6, wherein both the means for removably mounting the article holder on the article support stand; and the means for engageably cooperating with the mounting means of the article support stand is Velcro.

13. In combination:

an article holder, and an article support stand for removably mounting the article holder thereon;

the article support stand including a main body, the main body including a mounting side, and first and second support means for supporting the mounting side in at least two dispositions which are transverse to each other; and means for removably mounting an article holder on the body, the article holder mounting means being situated on the body at the mounting side thereof to allow the article holder to be mounted on the mounting side, the stand being selectively positionable to rest on one of the first support means, thereby supporting the article holder mounted thereon in a first disposition, and the second support means, thereby supporting the article holder mounted thereon in a second disposition which is transverse to the first disposition, the mounting side residing in an x-y coordinate plane which is perpendicular to a z-axis of rotation, the article support stand being adapted to be rotated about the z-axis of rotation so that the mounting side thereof is correspondingly turned within the x-y coordinate plane and adjusted in position within the x-y coordinate plane;

wherein the first support means includes a substantially planar support side of the main body, the support side being joined to the mounting side;

wherein each of the planar support side and mounting side of the main body is hollow and defines an interior space, the interior space of the support side being in communication with the interior space of the mounting side; and wherein the article support stand further includes a movable ballast, the ballast at least partially filling the interior spaces of the support side and mounting side and being adapted to move from the interior space of one side to the interior space of the other side when the stand is repositioned from one of the first and second dispositions to the other of the first and second dispositions;

the article holder including means for holding an article, means for supporting the article holding means, the article holding means being mounted thereon, and means mounted on the article holding support means for engageably cooperating with the article holder mounting means of the article support stand.

14. A combination as defined by claim 13, wherein the movable ballast is a liquid.

15. A combination as defined by claim 13, wherein the movable ballast is a solid.

* * * * *